US007351094B2

(12) United States Patent
Miyamoto

(10) Patent No.: US 7,351,094 B2
(45) Date of Patent: Apr. 1, 2008

(54) CONNECTOR

(75) Inventor: Toshifumi Miyamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/796,445

(22) Filed: Apr. 27, 2007

(65) Prior Publication Data

US 2007/0293080 A1 Dec. 20, 2007

(30) Foreign Application Priority Data

Jun. 15, 2006 (JP) ..... 2006-165892

(51) Int. Cl.
*H01R 13/56* (2006.01)

(52) U.S. Cl. ..... 439/447; 439/467; 439/157

(58) Field of Classification Search ..... 439/447, 439/467, 468, 157, 587, 589, 902
See application file for complete search history.

(56) References Cited

U.S. PATENT DOCUMENTS 5,300,734 A * 4/1994 Suzuki ..... 174/152 G
5,586,916 A * 12/1996 Shinji et al. ..... 439/752
5,601,449 A * 2/1997 Shinji et al. ..... 439/447
5,897,392 A * 4/1999 Takahashi et al. ..... 439/470
6,464,532 B1 * 10/2002 L'Abbate et al. ..... 439/467

FOREIGN PATENT DOCUMENTS

JP 9-82407 3/1997
JP 2005/0166575 8/2005

* cited by examiner

*Primary Examiner*—Hien Vu
(74) *Attorney, Agent, or Firm*—Gerald E. Hespos; Anthony J. Casella

(57) ABSTRACT

A grommet (30) has a wire pull-out part (32) that extends at an angle to a direction in which a female housing (10) fits to a mating male housing (90). Wires pulled out from the female housing (10) are inserted into the electric wire pull-out part (32). A locking hole (35) is formed on the grommet (30) near the wire pull-out part (32) and can be fit on a locking projection (11) on the female housing (10). A grommet cover (50) has a lid (51) that can be opened and closed. The lid (51) has a convex grommet-engaging portion (52) that engages the grommet (30) between the locking hole (35) and the wire pull-out part (32) when the lid part (51) is closed thus preventing a periphery of the locking hole (35) from deforming in a direction in which the wire pull-out part (32) shakes.

6 Claims, 6 Drawing Sheets

CONNECTOR

BACKGROUND OF THE INVENTION

1. Field of the Invention

The invention relates to a connector.

2. Description of the Related Art

Japanese Patent Application Laid-Open No. 2005-166575 discloses a connector to be mounted on a vehicle. The connector has a female housing that can be fit on a mating male housing. Female terminal fittings are connected to the ends of the electric wires and are accommodated in the female housing. A grommet is mounted to the female housing from the rear and covers the entire outer surface of the female housing except the fit-in surface. A cap-shaped grommet cover is mounted on the outer side of the grommet. A lever is mounted on opposite outer surfaces of the grommet cover and displays a cam action with the male housing to pull the housings together at a low fit-in force. The grommet is sandwiched between the grommet cover and the female housing. A locking projection is formed on the outer side surface of the female housing and is locked to locking holes formed on upper and lower surfaces of the grommet so the locking projection penetrates through the locking holes. Thus, the grommet is held unremovably on the female housing. An electric wire pull-out part extends down at the rear of the grommet cover and receives wires pulled out from the rear of the female housing.

The electric wire pull-out part shakes when the grommet is mounted on a vehicle body, and thus the grommet is pulled in the shaking direction. The bent lower portion of the grommet is continuous with the electric wire pull-out part and follows the shaking of the electric wire pull-out part. Thus, the bent lower portion of the grommet and the periphery of the locking hole deform. As a result, a gap may be generated between the inner periphery of the locking hole and the peripheral surface of the locking projection. In this case, water may penetrate through the gap and into the female housing. Accordingly, there is a fear that the connector will not be sufficiently waterproof.

The invention has been completed in view of the above-described situation. Therefore it is an object of the invention to provide a connector that is waterproof, even though an electric wire pull-out part shakes.

SUMMARY OF THE INVENTION

The invention relates a connector including a housing that is fittable in a mating housing and capable of accommodating terminal fittings connected with ends of electric wires therein. A grommet is disposed on an outer surface of the housing except a fit-in surface of the housing that fits on a fit-in surface of the mating housing. A hard grommet cover covers an outer surface of the grommet. The grommet has an electric wire pull-out part extending in a direction intersecting a direction in which the housing and the mating housing are fit together. The electric wires that are pulled out from an end surface of the housing are inserted into the electric wire pull-out part. A locking hole is formed on a side of the grommet that is continuous with the electric wire pull-out part and faces a side at which the electric wire pull-out part is extended. The locking hole can fit on a locking projection on the housing and locked thereto. The grommet cover has a lid that can be opened and closed to displace the lid between open and closed states with respect to the side. The lid has a convex grommet-engaging portion that engages the side in a region between the locking hole and a position close to the electric wire pull-out part when the lid is closed to prevent a periphery of the locking hole from deforming in a direction in which the electric wire pull-out part shakes. Accordingly, no gap is formed between the peripheral surface of the locking projection and the inner periphery of the locking hole and water will not penetrate into the housing.

The grommet-engaging portion projects towards the side of the grommet. The housing preferably has a concave grommet-receiving portion at a position corresponding to the grommet-engaging portion. The side of the grommet is sandwiched between the lid and the housing, and flexes on a different level conforming to configurations of the grommet-engaging portion and the grommet-receiving portion. The side of the grommet that is sandwiched tightly between the grommet-engaging portion and the grommet-receiving portion resists a tensile force generated by the shaking of the electric wire pull-out part. Consequently, the periphery of the locking hole will not deform.

A convexity preferably is formed on a peripheral edge of the locking hole disposed on outer surfaces of the side of the grommet; and the convexity can be crushed when the lid is closed. Therefore the inner peripheral surface of the locking hole makes a close and rigid contact with the peripheral surface of the locking projection. That is, the locking projection and the locking hole closely contact each other and prevent the gap from being generated therebetween.

The lid preferably is coupled to a body of the grommet cover through a hinge so that the lid can be opened and closed. The lid closely contacts a peripheral surface of the side of the grommet when the lid is closed. The lid has a closing portion adjacent to the grommet-engaging portion. The closing portion can lock to the body part for keeping the lid firmly closed. Thus, the grommet-engaging portion strongly engages the side part due to the addition of the closing force of the closing portion to prevent the periphery of the locking hole from being deformed.

DETAILED DESCRIPTION OF THE PREFERRED EMBODIMENTS

Figure 1:
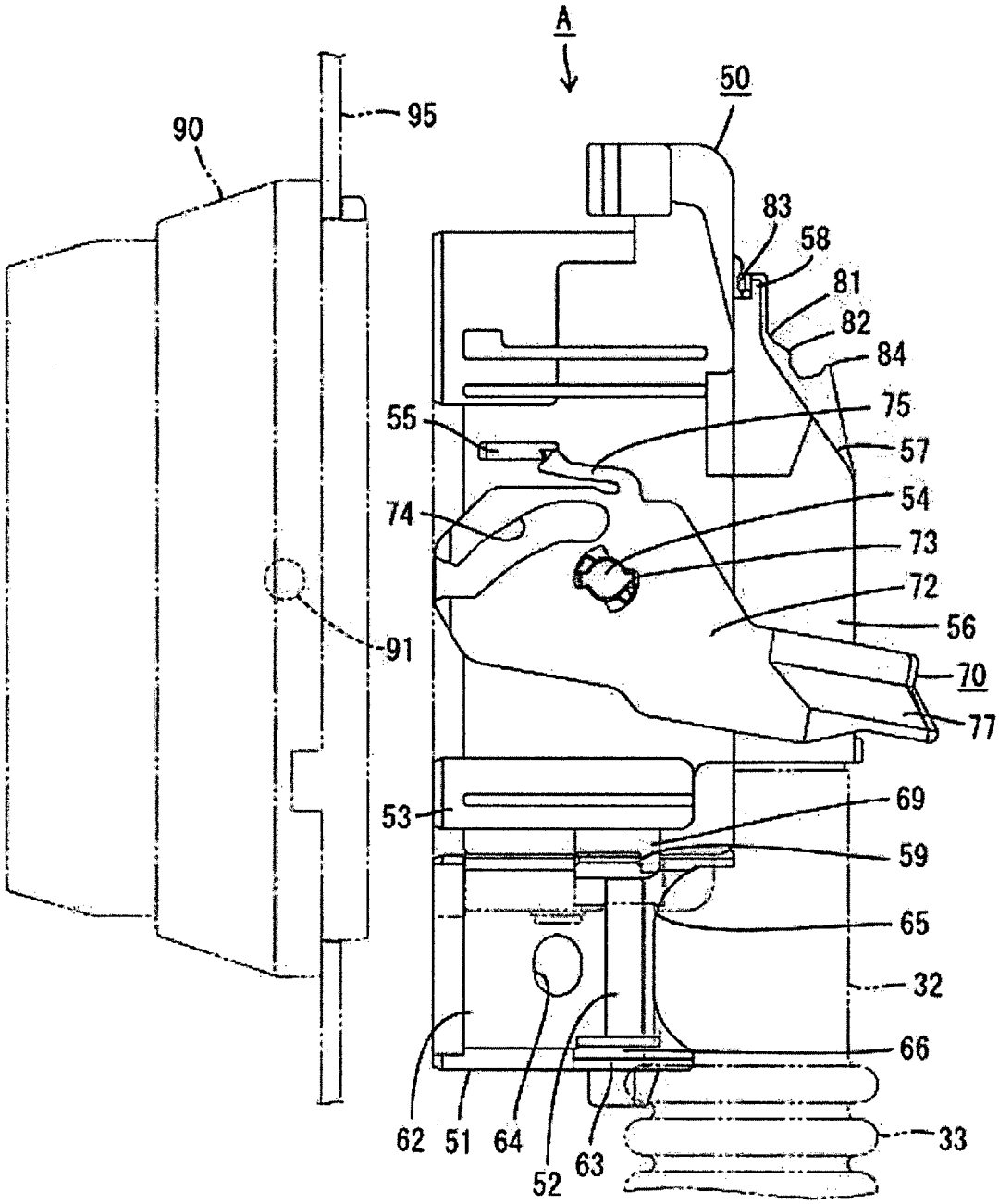
FIG. 1 is a side elevation showing a state in which a female connector of a first embodiment confronts a mating male connector.

A waterproof connector in accordance with the invention is identified generally by the letter A in FIGS. 1 to 6. The connector A has a female housing 10, a grommet 30, a grommet cover 50, and a lever 70. The female housing 10 can be fit in a mating male housing 90 that is mounted on a mounting hole of a panel 95. In the description below, a fit-in surface of the housing 10 that fits on a fit-in surface of the mating housing 90 is referred to as the front, and the vertical direction is based on the orientation in FIG. 1.

Figure 4:
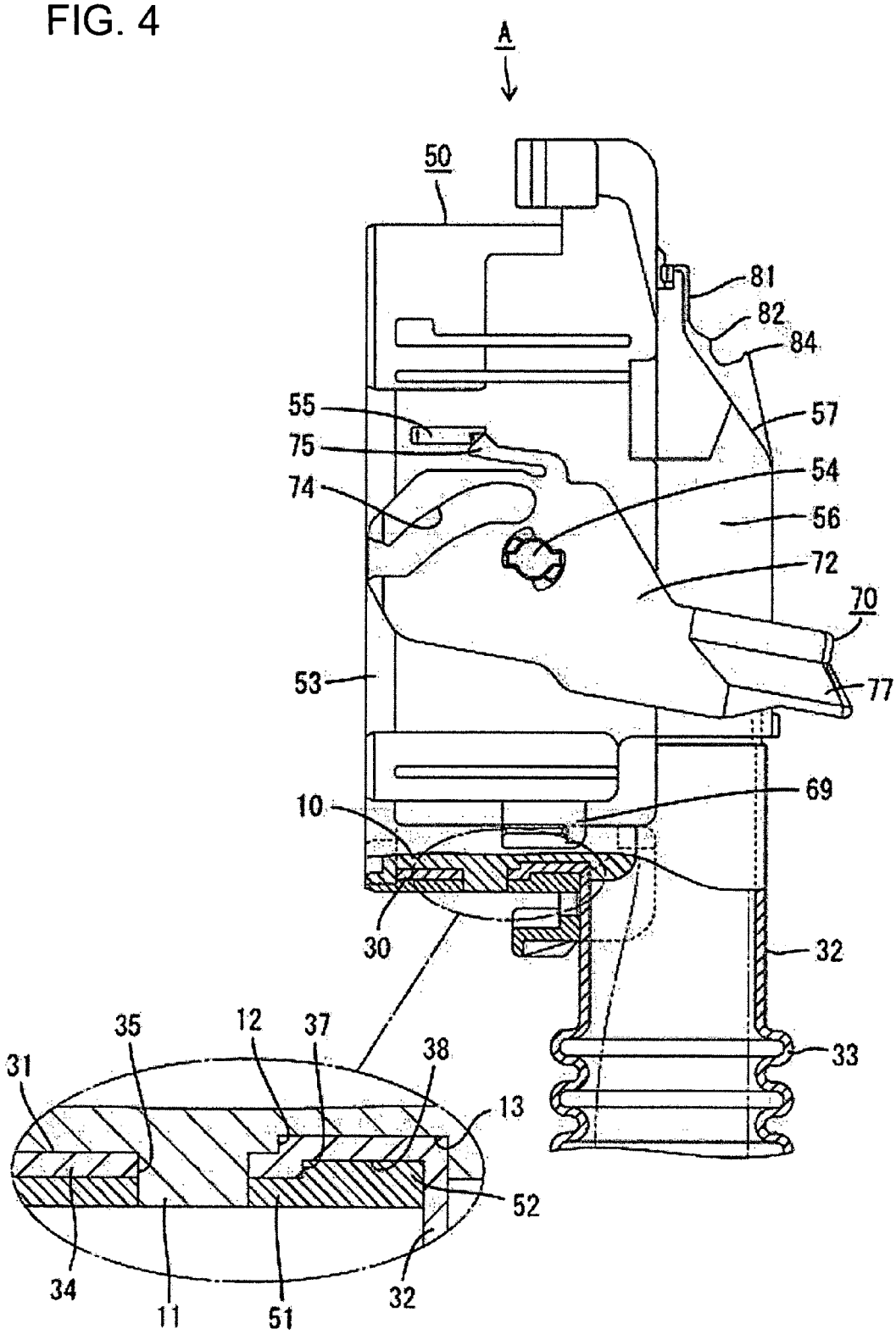
FIG. 4 is a side elevation showing a state in which a grommet is sandwiched between the lid and the female housing, by breaking away main parts.

The female housing 10 is made of synthetic resin and is a long narrow block that can accommodate female terminal fittings therein. Electric wires connected with the female terminal fittings are drawn out from the rear of the female housing 10 in a bundle and are bent down. All of the outer surfaces of the female housing 10 are covered by the grommet 30 except for a front surface thereof. Approximately columnar locking projections 11 are formed on the narrow upper and lower surfaces of the female housing 10 (only lower locking projection 11 is shown in FIG. 4). The grommet 30 and the grommet cover 50 are hooked and locked to the locking projections 11. A substantially vertically step 12 is disposed rearward of each locking projection 11 and grommet-receiving portions 13 are formed rearward of and adjacent to the respective steps 12. Thus, each grommet-receiving portion 13 defines a recess in the outer surface of the female housing 10.

The grommet 30 is made of rubber and thus is elastic. The grommet 30 includes a bag-shaped housing-accommodating part 31 and an approximately cylindrical electric wire pull-out part 32 that extends from the rear of the housing-accommodating part 31 at an angle to the direction in which the female housing 10 is fit in the mating male housing 90. In the illustrated embodiment, the electric wire pull-out part 32 extends down substantially orthogonal to the fit-in direction. The bundled electric wires drawn out of the rear surface of the female housing 10 are inserted into the electric wire pull-out part 32. Thus, the electric wire-pull-out direction in this embodiment is down. A corrugate bellows 33 extends from a position midway along the electric wire pull-out part 32 to the distal end thereof. The corrugate bellows 33 is longer than the height of the female housing 10 and is capable of shaking in a shaking direction of the electric wire pull-out part 32.

Figure 5:
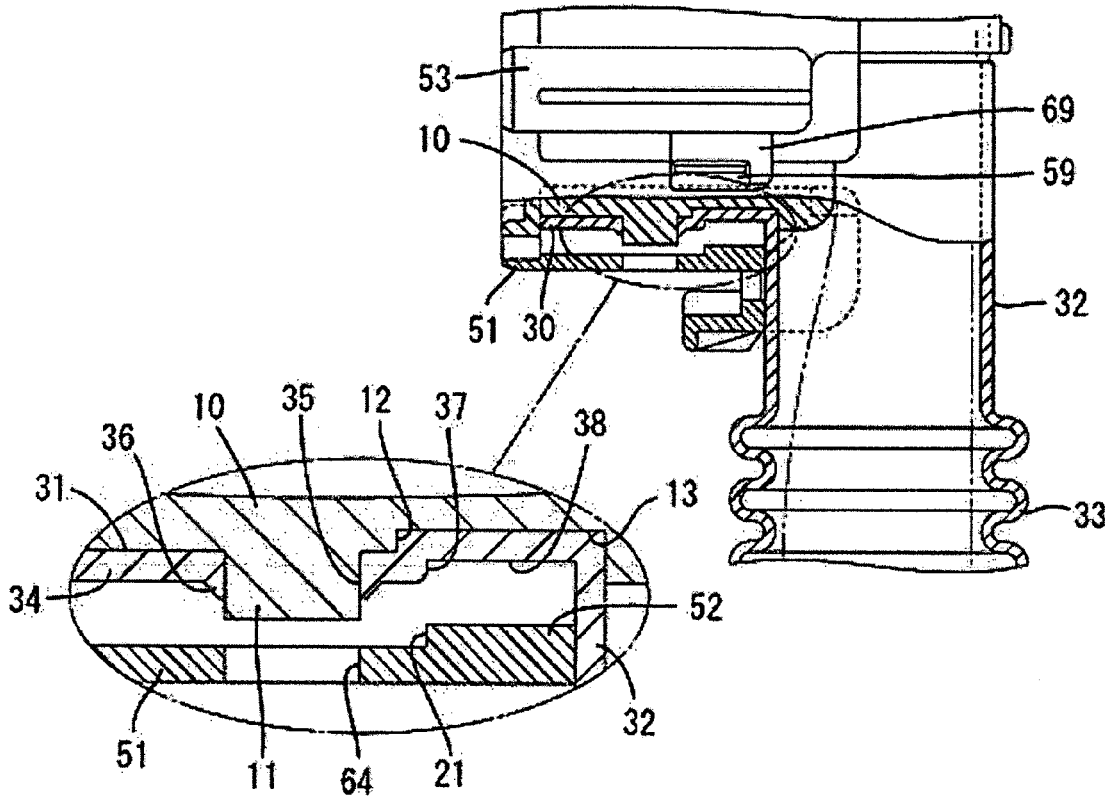
FIG. 5 is an enlarged side elevation showing a state in which the lid has not been closed, by breaking away main parts.
Figure 6:
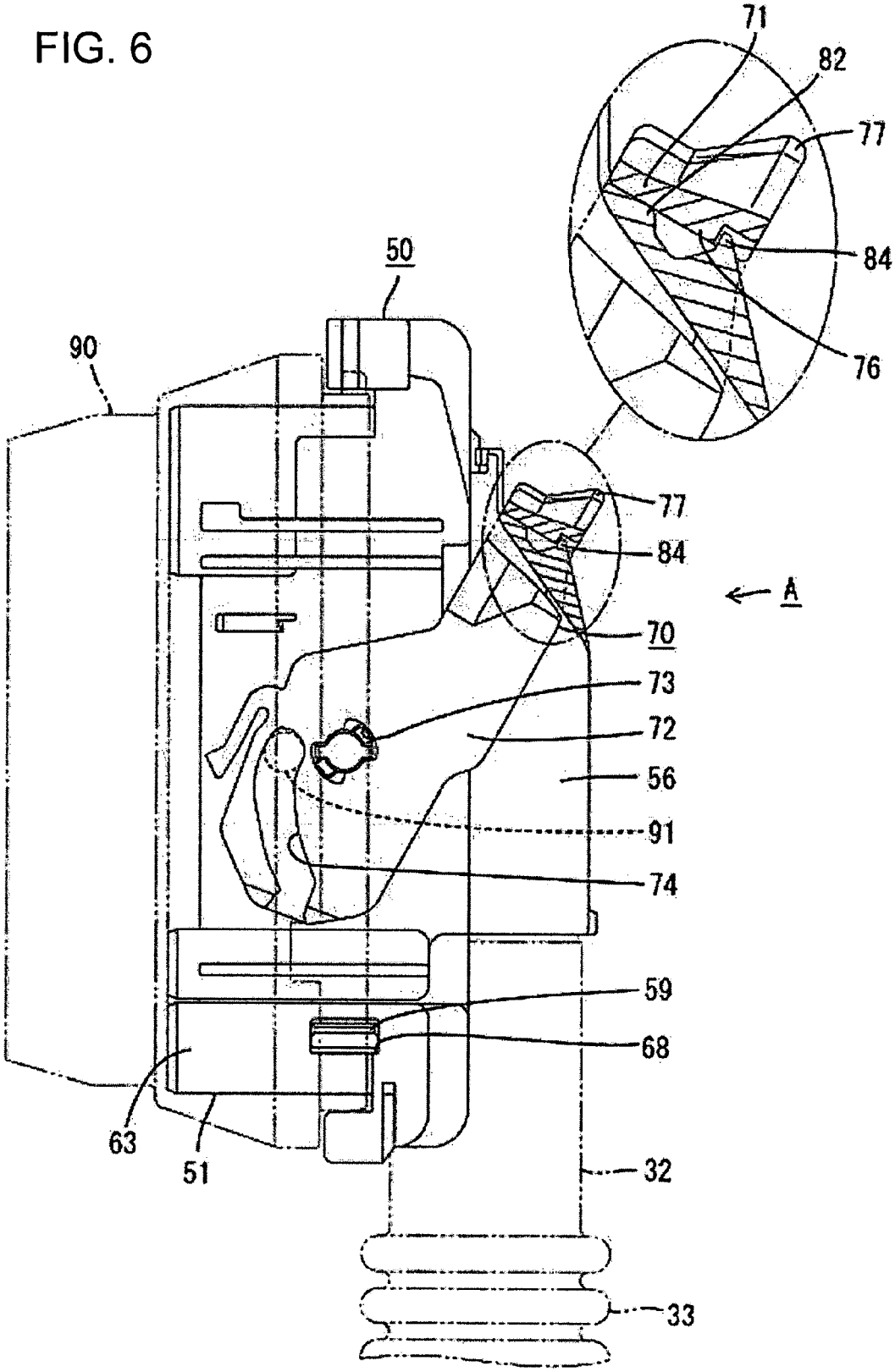
FIG. 6 is a side elevation showing a state in which the lever is locked to a lever-locking portion at the rotation-completed position.

The housing-accommodating part 31 of the grommet 30 has the shape of a long narrow rectangular frame that covers the four sides from the front end to the rear end of the female housing 10. The housing-accommodating part 31 has left and right side walls, a top wall and a bottom wall 34. A rear wall is continuous with rear ends of the left and right walls, the top wall and bottom wall 34 to cover the rear end of the female housing 10. The rear wall also is continuous with the base of the electric wire pull-out part 32. The bottom wall 34 of the housing-accommodating part 31 faces the extended side of the electric wire pull-out part 32. As shown in FIG. 5, the peripheral surface of the bottom wall 34 is continuous with and perpendicular to the peripheral surface of the electric wire pull-out part 32. Thus the region from the peripheral surface of the bottom wall 34 to the peripheral surface of the electric wire pull-out part 32 is substantially L-shaped.

Locking holes 35 penetrate through the upper and lower parts of the grommet 30 and can be fit on the locking projections 11 of the female housing 10. The hooked engagement of the locking projections 11 in the locking holes 35 prevents the grommet 30 from being removed from the female housing 10. The locking holes 35 of the housing-accommodating part 31 are approximately circular and closely contact the peripheral surface of the locking projection 11. As shown in FIG. 5, annular convexities 36 are formed circumferentially around the outer peripheral edges of the locking holes 35 of the grommet 30 and the inner peripheral surfaces of the convexities 36 can be brought into close contact with the peripheral surface of the locking projection 11.

A vertical step 37 is formed between the lower locking hole 35 and the wire pull-out part 32 and forms a concavity 38 on an outer surface of the lower part 34 at a level inward from the periphery of the outer surface. The concavity 38 extends from a position close to the locking hole 35 to a position close to the electric wire pull-out part 32. Additionally, the concavity 38 extends across the entire width of the lower part 34 and to the right-hand part of the housing-accommodating part 31 in a front view. That is, the concavity 38 is formed on two surfaces. An inner surface of the lower part 34, corresponding to the concavity 38 projects in trapezoidally due to molding the concavity 38. A projection of the lower part 34 fits in the grommet-receiving portion 13 of the female housing 10 and a grommet-engaging portion 52 on the lid 51 of the grommet cover 50 fits in the concavity 38 of the housing-accommodating part 31.

The grommet cover 50 is made of hard synthetic resin and has a cap shape configured for mounting on the outer surface of the grommet 30. The grommet cover 50 includes a body 53 with left and right side walls, an upper wall, and a rear wall. A lid 51 is a lower wall of the grommet cover 50 and is displaceable between a closed state to an open state with respect to the lower part 34 of the grommet 30. Two shafts 54 project from outer surfaces of the side walls of the body 53 for rotatably supporting the lever 70.

Figure 2:
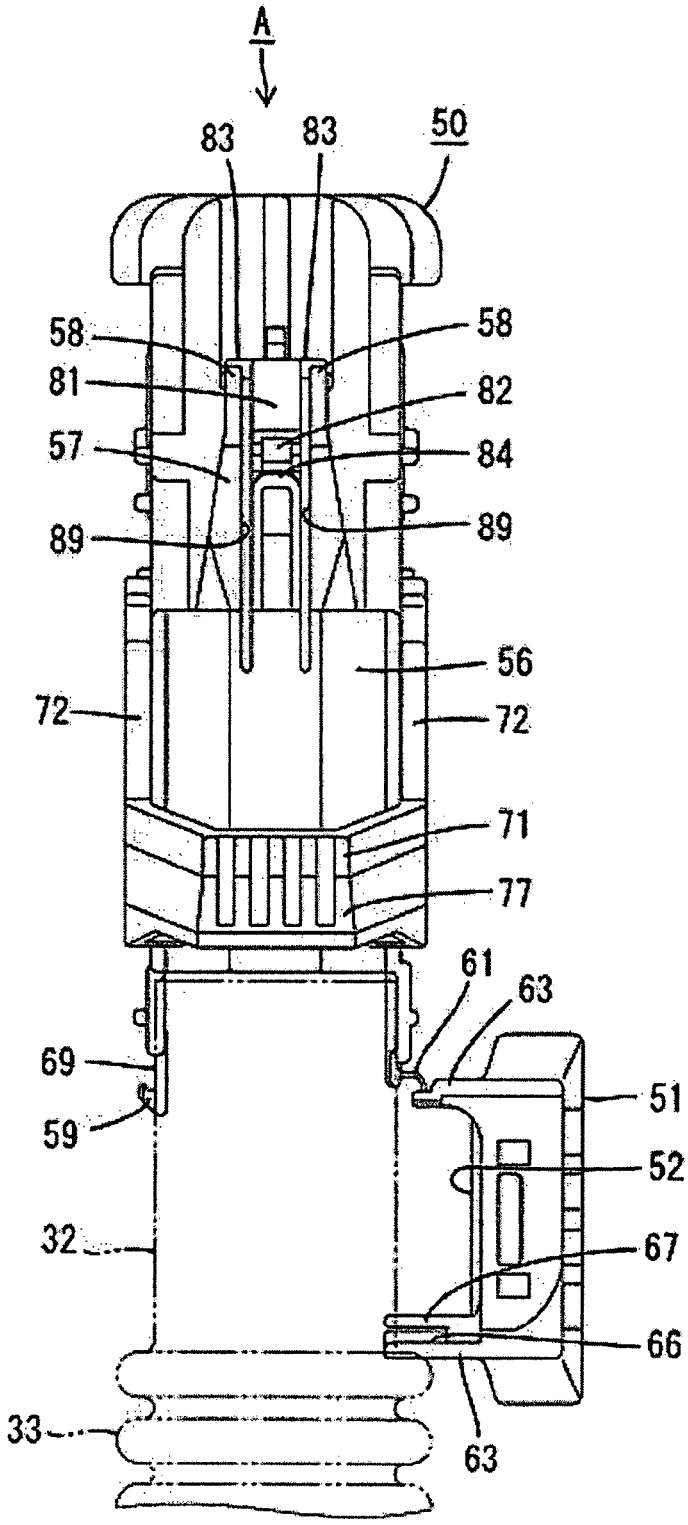
FIG. 2 is a rear view showing a state in which a lever is mounted on a grommet cover at an initial rotational position and a lid is open.
Figure 3:
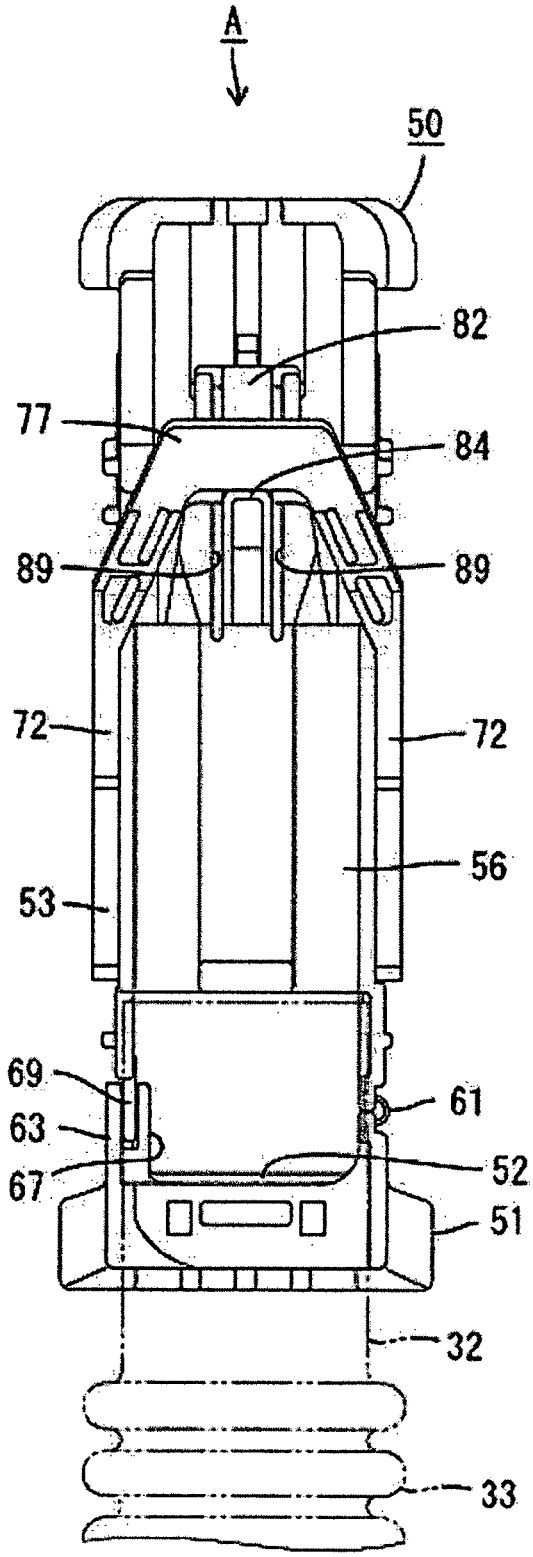
FIG. 3 is a rear view showing a state in which the lever is rotated to a rotation-completed position thereof to close the lid part.

The lever 70 also is made of synthetic resin. As shown in FIGS. 2 and 3, the lever 70 has an operation part 71 and left and right arms 72 that project from ends of the operation part 71 to define a U-shape. The lever 70 is mounted on the grommet cover 50 from the rear and straddles the grommet cover 50. A bearing hole 73 penetrates each arm 72 and the shafts 54 can be fit in the bearing holes 73. A cam groove 74 is formed near the bearing hole 73 and opens on the peripheral edge of each arm 72 to receive a pin-shaped cam follower 91 on the mating male housing 90. The operation part 71 can be grasped manually and rotated counterclockwise in FIG. 1 between an initial position at which the operation part 71 is near a lower end of a rear wall of the grommet cover 50 and a completed position at which the operation part 71 is near an upper end of the rear wall of the grommet cover 50. Both housings 10 and 90 can be fit slightly together with the lever 70 at the initial position so that the cam follower 91 advances into an entrance of the cam groove 74. The lever 70 then is rotated toward the rotation-completed position, and the cam follower 91 moves along the cam groove 74 to generate a cam action for pulling the housings 10 and 90 together. The housings 10 and 90 are fit together normally when the lever 70 reaches the rotation-completed position, and the male and female terminal fittings are connected electrically to each other in a normal depth.

An elastically deformable temporary holding piece 75 (see FIG. 4) is formed along a peripheral edge of each arm 72 and temporary holding ribs 55 extend longitudinally on the peripheral surfaces of both side walls of the grommet cover 50. The temporary holding pieces 75 lock to the temporary holding ribs 55 for holding the lever 70 at the initial rotational position. However, the temporary holding pieces 75 interfere with unlocking pieces on the male housing 90 at the start of an operation of fitting the female and male housings 10 and 90 together. As a result, the temporary holding piece 75 deforms elastically in an unlocking direction and disengages from the temporary holding rib 55 so that the lever 70 can be rotated.

An electric wire-accommodating portion 56 protrudes rearward on the grommet cover 50 and accommodates the electric wire pull-out part 32 of the grommet 30. The electric wire-accommodating portion 56 has an approximately trapezoidal cross-section and forms an electric wire-accommodating space therein. The operation part 71 of the lever 70 traverses the electric wire-accommodating portion 56 from a lower end to an upper end thereof during rotation of the lever 70. An oblique wall 57 extends up and to the front from the upper end of a rear wall of the electric wire-accommodating portion 56 and a lever lock 81 is formed along the oblique wall 57. As shown in FIG. 2, the lever lock 81 is disposed between left and right slits 89 and cantilevers up from a lower rear position on the oblique wall 87. Thus, the lever lock 81 can flex elastically about the support at the lower rear position on the oblique wall 57. A locking-receiving portion 82 projects rearward in the shape of a mountain and the operation part 71 of the lever 70 can fit to the locking-receiving portion 82 to lock the lever 70 at the rotation-completed position. Flex-preventing pieces 83 project at left and right sides of a distal end of the lever lock 81 and contact a flexing-preventing wall 58 that projects from the upper front end of the oblique wall 57 to prevent the lever lock 81 from flexing excessively rearward.

A mountain-shaped projection 84 projects on the lever lock 81. The operation part 71 of the lever 70 interferes with the projection 84 when the lever 70 reaches the last rotational stage and causes the lever lock 81 to flex forward. The operation part 71 separates from the projection 84 when the lever 70 reaches the rotation-completed position. As a result, the lever lock 81 returns elastically to its original state, and a fit-in lock 76 on an inner wall of the operation part 71 fits in the lock-receiving portion 82 (see FIGS. 3 and 6). The lock-receiving portion 82 strikes the fit-in lock 76 when the lever lock 81 returns elastically to its original state and creates a locking sound with a snap to provide an aural indication that the lever 70 has been locked.

A finger-applying portion 77 is formed in a rear of the operation part 71 of the lever 70 and is one step higher than a front portion of the operation part 71 in a rotational direction of the lever 70 towards the rotation-completed position. The finger-applying portion 77 is sectionally triangular and projects over the whole width of the operation part 71. A finger applied to the finger-applying portion 77 during rotation of the lever 70 will not interfere with the lever lock 81. Therefore, the lever lock 81 will not be deformed elastically by the finger during rotation of the lever 70 and the lever 70 will not be locked abnormally. Consequently, the above-described locking sound is generated reliably and the lever 70 will not be stopped before reaching the rotation-completed position.

As shown in FIGS. 2 and 3, the lid 51 of the grommet cover 50 is coupled to a lower edge of the body 53 through a hinge 61 so that the lid 51 can be opened and closed. The grommet cover 50 is mounted from the rear on the female housing 10 covered with the grommet 30. The lid 51 can be rotated about the hinge 61 and closed to cover an outer surface of the lower part 34 of the grommet 30. The hinge 61 is flexible and belt-shaped and is connected entirely with one-side lower edge of the body 53 and one-side edge of the lid 51.

The lid 51 has a flat portion 62 (see FIG. 1) that covers the lower part 34 of the grommet 30 and side covers 63 are erected from both side edges of the flat portion 62 for covering left and right parts of the grommet 30. Thus, the lid 51 is U-shaped in section and constitutes the lower part of the grommet cover 50. A through-hole 64 is formed at approximately the center of the flat portion 62. The locking hole 35 of the grommet 30 and the through-hole 64 register with each other, and the locking projection 11 of the female housing 10 fits in both the locking hole 35 and the through-hole 64. An approximately U-shaped concavity 65 is formed at a rear edge of the lid 51 and can receive the base of the electric wire pull-out part 32.

The grommet-engaging portion 52 projects towards the concavity 38 of the grommet 30 from a position on an inner surface of the lid 51 between the through-hole 64 and the concavity 65 and is defined partly by a step 21 (see FIG. 5) that extends almost perpendicularly on the flat portion 62. As shown in FIG. 1, the grommet-engaging portion 52 is belt-shaped in a plan view and crosses the whole width of the flat portion 62. Accordingly, the grommet-engaging portion 52 is thicker than regions of the flat portion 62 forward and rearward of the grommet-engaging portion 52.

A closing portion 66 (see FIGS. 1 and 2) is formed at a position on the lid 51 opposite the hinge 61 and can be locked to the body 53. The closing portion 66 includes a planar partitioning plate 67 that extends from the flat portion 62 and is approximately parallel with the side covers 63. An approximately rectangular closing hole 68 penetrates the side cover 63 that is remote from the hinge 61 and confronts the partitioning plate 67. A flat closing-receiving portion 69 projects down at an edge of the body 53 opposite to the hinge 61 and can move into a space between the partitioning plate 67 and the side cover 63. A closing claw 59 projects out at a distal end of the closing-receiving portion 69 and interferes with a distal end of the side cover 63 while the lid 51 is being closed. As a result, the closing-receiving portion 69 deforms elastically inward. The closing-receiving portion 69 returns elastically to its original state when the lid 51 is disposed on the lower part 34 of the grommet 30 in a normal depth. As a result, the closing claw 59 fits in the closing hole 68 and the lid 51 is locked to the body 53.

The connector is assembled by inserting the female terminal fittings connected with ends of electric wires into the female housing 10 from the rear. The bundled electric wires then are inserted into the electric wire pull-out part 32 of the grommet 30 and the grommet 30 is disposed on the female housing 10 from the rear. As a result, the housing-accommodating part 31 of the grommet 30 covers all of the female housing 10 except the front surface thereof and the locking projections 11 of the female housing 10 penetrate through the locking holes 35 at the top and bottom of the grommet 30 to prevent removal of the grommet 30.

The grommet cover 50 then is mounted on the female housing 10 from the rear. As a result, the body 53 nests over and surrounds the upper surface and the left and right surfaces of the grommet 30. The lid 51 initially is open and the outer surface of the lower part 34 of the grommet 30 is exposed. The closing portion 66 and the closing-receiving portion 69 lock together as the lid 51 is closed and keep the lid 51 in a closed state. Additionally, the locking projection 11 penetrates the through-hole 64 to keep the lid 51 in position. The grommet-engaging portion 52 fits in the concavity 38 of the grommet 30 when the lid 51 is closed. More specifically, the steps of the grommet-engaging portion 52 and the concavity 38 contact each other along the vertical direction approximately orthogonal to the fit-in direction of both housings 10 and 90. At the same time, the grommet-receiving portion 13 of the female housing 10 engages the concavity 38 of the grommet 30. More specifically, the steps of the grommet-receiving portion 13 and the concavity 38 contact each other along the vertical direction approximately orthogonal to the fit-in direction of both housings 10 and 90.

As shown in FIGS. 3 through 5, the convexity 36 of the grommet 30 contacts the peripheral edge of the through-hole 64 of the lid 51 when the lid 51 is closed. As a result, the lid 51 crushes the convexity 36 in the thickness direction thereof and the locking projection 11 closely contacts the locking hole 35.

The male housing 90 then is disposed in confrontation with the female housing 10 to start the operation of fitting the housings 10 and 90 together. At this time, the lever 70 is rotated from the initial position to the rotation-completed position to perform the fit-in operation with a low fit-in force. At the normal fit-in state, the female housing 10 is fit in the male housing 90. Additionally, the grommet cover 50 mounted on the female housing 10 and the fit-in lock 76 locked to the locking-receiving portion 82 of the grommet cover 50 to prevent the lever 70 from moving. To return the lever 70 to the initial position, the projection 84 of the lever-lock 81 is pressed to deform the lever-lock 81 elastically in a direction to unlock the lever-lock 81 from the fit-in lock 76 so that the lever 70 can be rotated toward the initial position.

The electric wire pull-out part 32 of the grommet 30 mounted on a vehicle body may shake in a direction intersecting the extending direction of the bundled electric wires. For example, the electric wire pull-out part 32 may shake rearward. As a result, a tensile stress may act on the lower part 34 of the grommet 30 near the electric wire pull-out part 32 along the direction in which the electric wire pull-out part 32 shakes. Consequently there is a fear that the periphery of the locking hole 35 of the grommet 30 will follow the shaking of the electric wire pull-out part 32 and will deform sufficiently so that the inner peripheral surface of the locking hole 35 will separate from the peripheral surface of the locking projection 11 of the female housing 10. In this situation, a gap could be created between the locking hole 35 and the locking projection 11. However, the convex grommet-engaging portion 52 of the lid 51 engages the concave portion of the lower part 34 of the grommet 30 between the locking hole 35 and the electric wire pull-out part 32. Thus, the grommet 30 is prevented from making a follow-up deformation and the position of the locking hole 35 relative to the grommet-engaging portion 52 remains substantially fixed. Therefore it is possible to prevent a gap from being generated between the peripheral surface of the locking projection 11 and the inner peripheral surface of the locking hole 35. Consequently, the electric wire pull-out part 32 is prevented from shaking and water cannot penetrate into the female housing 10. Thus it is possible to keep the female housing 10 waterproof.

The lower part 34 of the grommet 30 is sandwiched between the lid 51 and the female housing 10, with the lower part 34 flexing on a different level in conformity to the configurations of the grommet-engaging portion 52 and the grommet-receiving portion 13. Thus, the lower part 34 of the grommet 30 is sandwiched tightly between the grommet-engaging portion 52 and the grommet-receiving portion 13 and resists tensile forces generated by shaking of the electric wire pull-out part 32. Consequently, follow-up deformation will not occur on the periphery of the locking hole 35 of the grommet 30.

The convexity 36 on the periphery of the locking hole 35 is crushed by the lid 51 in the thickness direction when the lid 51 of the grommet cover 50 is disposed on the lower part 34 of the grommet 30. Therefore the inner peripheral surface of the locking hole 35 makes a close and rigid contact with the peripheral surface of the locking projection 11. That is, the locking projection 11 and the locking hole 35 closely contact each other and prevent the gap from being generated therebetween.

When the lid 51 of the grommet cover 50 is disposed on the lower part 34 of the grommet 30, the closing portion 66 is locked to the body 53, thus keeping the lid 51 closed firmly. In this case, the closing portion 66 is formed adjacent to the grommet-engaging portion 52. That is, the grommet-engaging portion 52 is disposed in the range that is influenced by the closing force of the closing portion 66. Thus, the grommet-engaging portion 52 strongly engages the lower part 34 of the grommet 30 due to the addition of the closing force of the closing portion 66. Therefore it is possible to prevent the periphery of the locking hole 35 from making the follow-up deformation.

The invention is not limited to the above-described embodiments, and the following embodiments are included in the scope of the invention. Various other modifications can be made without departing from the scope of the invention.

The grommet-engaging portion fits in the concavity of the grommet in the preferred embodiment. However, the periphery of the locking hole can be prevented from deforming by the engaging operation of the grommet-engaging portion, any constructions can be adopted. For example, the grommet-engaging portion may have a projection capable of cutting into the lower part of the grommet when the lid is closed.

In the illustrated embodiment, the lid is coupled to the body through the hinge. However, the lid may be formed separately from the body part.

The invention is applicable to a male waterproof connector including a male housing on which the grommet, the grommet cover, and the lever are mounted.

What is claimed is:

1. A connector comprising:

a housing with opposite front and rear ends and side walls extending between the ends, a locking projection projecting outwardly in a projecting direction on one of the side walls of said housing, a grommet-receiving concavity formed between the locking projection and the rear end of the housing, the grommet-receiving concavity including a step extending substantially in the projecting direction;

a rubber grommet substantially covering the side walls and the rear end of said housing, a locking hole formed through the grommet and being fit on the locking projection of the housing, the grommet being formed with an elongated tubular wire pull-out part transversely extending from the rear end of the housing and projecting substantially parallel to the projecting direction of locking projection, portions of the grommet between the wire pull-out part and the locking hole being nested in the grommet-receiving concavity; and a hard grommet cover covering an outer surface of said grommet, said grommet cover having a lid that can be moved between open and closed states with respect to said grommet, said lid having a convex grommet-engaging projection that is aligned with and nested in the grommet-receiving concavity and holds the portions of the grommet in the grommet-receiving concavity and against the step when the lid is closed for preventing a periphery of said locking hole from deforming in a direction transverse to said wire pull-out part.

2. The connector of claim 1, wherein portions of the grommet between the wire pull-out part and the locking hole are non-planar.

3. The connector of claim 1, wherein a convexity is formed on an outer peripheral edge of said locking hole in said grommet (30), said lid being configured to deform the convexity towards the locking projection.

4. The connector of claim 1, wherein said lid is coupled to a body of said grommet cover by a hinge.

5. The connector of claim 4, wherein said lid has a closing portion substantially adjacent said grommet-engaging portion and being engageable with said body for keeping said lid closed.

6. The connector of claim 5, wherein the hinge is unitary with both the lid and the body.

* * * * *